US006468516B1

(12) United States Patent
Geria et al.

(10) Patent No.: US 6,468,516 B1
(45) **Date of Patent: *Oct. 22, 2002**

(54) COMPOSITION AND MANUFACTURE OF TOPICAL PHARMACEUTICAL AND COSMETIC SEMI-SOLID POST-FOAMING DOSAGE FORMS IN A POUCH

(75) Inventors: Navin Geria, Warren, NJ (US); Joseph Melillo, Fuchu (JP)

(73) Assignee: Warner-Lambert Company, Morris Plains, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/272,540

(22) Filed: Mar. 19, 1999

(51) Int. Cl.[7] ..... A61K 7/15
(52) U.S. Cl. ..... 424/73
(58) Field of Search ..... 424/73

(56) References Cited

U.S. PATENT DOCUMENTS 5,849,279 A * 12/1998 Cauwenbergh ..... 424/70.8

6,228,894 B1 * 5/2001 Rinaldi et al. ..... 514/951

* cited by examiner

*Primary Examiner*—James M. Spear
(74) *Attorney, Agent, or Firm*—Peter C Richardson; Gregg C Benson; Raymond D Thompson

(57) ABSTRACT

A pouch containing a non-pressurized post-foaming gel, wherein the gel within the pouch is enclosed within an inert atmosphere, such as a nitrogen blanket, which protects the gel and prevents premature foaming and the separation of the gel's components. Upon opening the pouch and discharging the contents, the heat of the user's skin allows a low boiling point hydrocarbon, such as isopentane, to cause the gel to foam, thus providing the consumer with an instant benefit which could include cleansing, moisturizing, increasing shave comfort, wound treatment, etc. Further, the process to produce a gel which is suitable for use in a single use delivery system involves the steps of containing the gel in a jar, spraying the gel with nitrogen to remove the air from the jar, and then swirling the jar to form a non-aerated gel without weight variation problems.

3 Claims, No Drawings

COMPOSITION AND MANUFACTURE OF TOPICAL PHARMACEUTICAL AND COSMETIC SEMI-SOLID POST-FOAMING DOSAGE FORMS IN A POUCH

BACKGROUND OF THE INVENTION

1. Field of the Invention

This invention relates to a non-pressurized pouch containing a post-foaming gel composition and a process for producing pouches containing such a gel.

2. Description of Related Art

Many individuals prefer wet shaving in order to achieve a close and comfortable shave. Wet shaving involves the use of some sort of soap, shaving cream or gel in combination with water and a razor. Most commonly, the surface to be shaved is wetted, the soap, cream, or gel is applied and then the surface is shaved with the razor. Over the years, many various types of shave creams and gels have been utilized. One category of shaving gels which is particularly favored are post-foaming gels. These gels are favored in that they are often more lubricious than regular shaving creams and consequently often produce a more comfortable shave. Post-foaming gels are currently only available in pressurized aerosol delivery systems which contain a propellant. Such delivery systems comprise a metal can containing a bag which holds the gel. A pressurized gas within the can, but outside of the bag, compresses the bag. The gas compresses the bag further and further as the gel is dispensed. A low boiling hydrocarbon such as isopentane is generally mixed into the gel; the hydrocarbon boils at skin temperature and consequently causes the gel to foam upon contact with the skin.

Major drawbacks of post-foaming gels in aerosol cans include the inability to provide a convenient single use system and the requirement that the material be maintained at a high pressure within the packaging. Attempts to produce single use gel packages have previously failed due to an inability to maintain the gel components in a homogeneous state within the package. It would be advantageous to provide a post-foaming gel delivery system which may be used in a single use form and which does not require the extreme pressurization of an aerosol system. Accordingly, it is an objective of the present invention to provide a post-foaming gel single use delivery system and a process for formulating the gel so that it is suitable for use within the system.

SUMMARY OF THE INVENTION

The present invention is directed to a pouch containing a non-pressurized post-foaming gel. The gel within the pouch is enclosed within an inert atmosphere, such as a nitrogen blanket, which protects the gel and prevents premature foaming and the separation of the gel's components. Upon opening the pouch and discharging the contents, the heat of the user's skin allows a low boiling point hydrocarbon, such as isopentane, to cause the gel to foam. Further, the process to produce a gel which is suitable for use in a single use delivery system involves the steps of containing the gel in a jar, spraying the gel with nitrogen to remove the air from the jar, and then swirling the jar to form a non-aerated gel without weight variation problems.

DETAILED DESCRIPTION OF THE PREFERRED EMBODIMENTS

Reference will now be made to the presently preferred embodiments of the present invention. Shave gels for use during wet shaving have been utilized for many years. These gels are contained within an aerosol system and comprise various elements, including a propellant, a low boiling hydrocarbon, water, soap, perfume and dye. The gel is maintained under pressure within a bag in the aerosol system. The hydrocarbon boils at skin temperature and consequently the gel foams upon release from the aerosol can and contact with skin.

Pouches are convenient and useful for protecting products in a single use package. Pouches are especially useful in that they may be constructed from FDA-approved materials and provide the additional benefit of a large, flat exterior surface upon which advertising may be printed. Generally, pouches consist of three layers: the protective layer, the barrier layer, and the sealant layer. The protective layer, the interior layer, is chosen for and provides the qualities of heat resistance, strength, printability and machineablility. Various materials which are useful for this layer include polyester, PET nylon 6, nylon 6,6, OPP, paper or combinations thereof. The barrier layer protects the contents of the pouch from light, moisture and oxygen penetration. Materials which are useful for the barrier layer include foil, ceramics, metalized films, opaque films, printed films, transparent films, metalized polypropylene, metalized polyester, high density polythylene, clear polyproplyene, polyester, low density polyethylene, nylon, PVA coated polypropylene, polyvinylidene copolymer coated polypropylene, polyvinylidene copolymer coated polyester, polyethylene films, aluminum, or combinations thereof. Finally, the sealant layer, the exterior layer, is chosen for purposes of sealability, bulk and strength. Among the materials which may be utilized for the sealant layer are polyethylene, ethylene vinyl acetate, acid copolymers, ionomeric copolymers, polypropylene, polyvinyl chloride, polyacrylonitriles, polyester, nitrocellulose, waxes, hot melts, polychlorotrifluoroethylene copolymers, cold seals, pressure sensitive adhesives, resin adhesives such as SURLYN®, LLDPE, acrylonitrile copolymers such as BAREXO®, sealant film, EAA, low density polyester or combinations thereof.

Two main methods, adhesive laminations and extrusion laminations, exist for adhering the different layers of pouches together. For adhesive laminations a thermoset polyurethane adhesive is normally used as the bonding media. Among the benefits of the adhesive laminations method is that the process requires only a short set up and preparation time. Extrusion laminates utilize a molten layer of thermoplastic material as a bonding media. Examples of such thermoplastic materials include polethylene, polyethylene copolymer and polyethylene extrusion. The actual sealing process may be performed by heat in combination with pressure, pressure only for cold seals or pressure sensitive adhesives, induction via radio frequency or ultrasonic.

The choices of materials for each of the layers and the sealing process are dependent upon the desired properties of the pouch. In addition, multiple interior layers may be utilized for specialized purposes. For example, to provide a pouch with a high degree of child safety and resistance to puncture, an inner paper layer and an outer sealant layer would be utilized in conjunction with inner layers of polyester and one or more thermoplastic films. While many various combinations of layers may be employed, examples of pouches which are satisfactory for holding shave gel are as follows (each layer is listed): paper 50 grams/aluminum 0.0005/copolymer 30 microns; paper 50 grams/aluminum 0.0005/Surlyn 60; 48 gauge polyester/aluminum 0.0005/48 gauge polyester/LLDPE 75 microns; 48 gauge polyester/ aluminum 0.0005/LLDPE 70 microns; 48 gauge polyester/aluminum 0.0005 /copolymer 20/LLDPE 60; 48 gauge polyester/7.5#EAA/0.0003 foil/7.5#EAA/1.75 mil. Barex; 92 gauge polyester/ink/15# whiteEAA/0.00035 foil/adhesive/1 mil proprietary sealant film; 48 gauge polyester/aluminum 0.00035/1 mil Proprietary sealant film; 48 gauge polyester/aluminum 0.0005/LLDPE 100; 48 gauge polyester/adhesive/0.00035 foil/adhesive/3 mil cast polypropylene film; 26# C1S paper/7.2#LDPE/0.00035 foil/29#EAA; 26# C1S paper/7.2#LDPE/0.00035 foil/22.5#LDPE; and 26# C1S paper/7.2#LDPE/0.00035 foil/22.5# 1702 Surlyn. Combinations which are especially preferred for shave gel pouches include 48 g. PET/0.003 foil/10.8# CRC-1; 48 g. PET/3 mil. LLDPE; 100 g. Nylon/2.5 mil. LLDPE; 48 g. PET/0.00035 foil/1.75 mil. Barex, 0.48 mil. PET/INK/WLDPE 0.75 mil.; Al foil 0.3 mil./EAA 0/75 mil./Barex film 3.5 mil./product. For the various combinations, the foil thicknesses may vary.

The substrates that are particularly suitable for this flexible packaging application include papers (machine glazed, machine finished, clay coated, natural kraft, super calendered), films (polypropylene, polyester, nylon, cellophane), and foil (laminated foils). Each layer consists of a complex structure to protect the gel contained in the pouch. The complex structures can have as many as four to six different layers, including the sealant layers which may consist of LLDPE, EAA, CRC Surlyn, Barex, or Scotch Pack 7.5 mil. Tyvec with heat seal coating with one side sealable. The sealant layer is determined based on historical data and testing. Pouches can have offset gravure and flexographic printing. The pouches may have as much or as little color printing as is desired, and preferably eight color printing. Further, the pouches may be of any desired size or shape. Preferred sizes for the pouches are 2"×4" and 3"×3". The pouches can also be tandem co-extruded and laminated. The pouches are preferably formed on horizontal Bartel machinery or on vertical machinery such as circle and wrap aids having multiple pouches. The Bartel machinery is the most preferable machinery for manufacture. All the pouches are subjected to stability testing. At 70° F., the weight losses from these structures should be zero. The final pouch contains a product which is a semi-solid product that will generate instant foam when the product is briskly rubbed against dry or wet skin.

The shave gel to be utilized in a pouch has four essential components. The first essential component is a soap, i.e., a water soluble salt of a higher fatty acid, such as C10–C24 fatty acids. Soaps are well known in the art and may be prepared in any conventional manner. For example, soaps may be prepared by reacting a basic material such as triethanolamine directly with a higher fatty acid, such as stearic, palmitic, myristic, oleic, coconut oil fatty acids, soya oil fatty acids, or a mixture of the oils. The nature of the soap used, although not critical to the final product, has an effect on the type of shave gel ultimately produced. Preferred soaps include the water-soluble stearate and palmitate soaps, such as the potassium, ammonium and soluble amine soaps of commercial stearic acid and palmitic acid. The triethanolamine soap is preferred. The soaps may be made by neutralization of the appropriate higher fatty acid with a suitable alkali, or may be introduced in the form of animal fats, such as tallow, or vegetable fats, such as palm oil, which are rich in the appropriate acid and which, when saponified, form soaps rich in the corresponding acid. A second essential component of shave gel is water. Generally, the amount of water employed in the gel may be varied depending upon the properties desired in the final product.

The third essential element in the shave gel is volatile organic foam producing liquid, i.e., a post-foaming agent, which is compatible with the other components of the gel. The vapor pressure of the post-foaming agent is critical, in that a lather should be produced by volatilization of the post-foaming agent when the gel is rubbed between the fingers or on the skin. Suitable liquids for use include saturated aliphatic hydrocarbons having from 4–6 carbon atoms, such as butanes, pentanes and hexanes, and preferably isopentane and isobutane. Generally, suitable post-foaming agents are those substances which have a low stability in water, for example less than about 20 cc of gas in 100 grams of water at one atmosphere and 20° C. The amount of inert volatile agent used in the compositions of the present invention may have an important effect on the properties of the composition, including the stability of the foam, the yield value, post-foaming characteristics of the gel compositions and the overall foam character. The amount of volatile agent whether as propellant, or as post-foaming agent, may however, routinely be varied by the person skilled in the art to optimize the desired characteristics of the gel or the foam. Aliphatic hydrocarbon volatile agents would typically comprise 0.5–30% by weight of the composition, and most preferably about 10–20% by weight of the composition. A final essential component of the shave gel is a minor amount of and inert gas. Preferred inert gases include carbon dioxide, nitrogen and nitrous oxide and can be included within the pouch before sealing. Typically, about 5–30 ml by weight of inert gas is used, with most preferably about 5–10 ml by weight.

One example of an acceptable shave gel composition is as follows:

EXAMPLE

| Ingredient | % w/w |
|---|---|
| Propylene glycol | 7.50 |
| Myristic acid | 5.00 |
| Palmitic acid | 3.00 |
| Triethanolamine | 8.00 |
| Polysorbate 20 | 3.00 |
| Choleth-24 (and) Ceteth-24 | 3.00 |
| Hydroxyethyl cellulose | 1.60 |
| Phenoxy ethanol | 0.50 |
| Tetra sodium EDTA | 0.30 |
| Fragrance | 0.30 |
| Methyl Paraben | 0.20 |
| Propyl Paraben | 0.10 |
| Isopentane | 5.00 |
| Nitrogen | 5.00 |
| Water | 57.50 |
| Total | 100.00 |

Previous attempts to fill pouches such as those listed above have failed due to an inability to produce a shave gel which would remain in a homogeneous, non-foamed state within the pouch. Such early attempts produced a shave gel which separated into water and semi-solid portions. In order to maintain the shave gel in a proper manner, the gel must be also be maintained at a consistent weight. To produce a proper gel the gel component and the post-foaming agent component, such as 5% isopentane or 10% isopentane, should be placed within a jar, preferably a widemouth jar, with a sealing cap. The gel, which preferably is maintained at room temperature, is then sprayed with nitrogen to remove the air from the jar and the sealing cap is tightly placed on top of the jar to create a closed atmosphere. The jar is then swirled in order to mix the components and form a non-aerated gel which will not have weight variation problems. In the example set forth above, the gel may be manufactured by first charging a vessel with propylene glycol. Hydroxyethyl cellulose is added gradually until the mixture is dispensed and homogeneous. One third of the water is then added to the mixture and the mixture is left to gel. Next, a main mixing vessel is charged with one third of the water and heated to 80 C. Myristic acid and palmitic acid are stirred into the vessel until the mixture is melted. The composition is maintained at 80 C until the mixture is a homogeneous solution. The mixture is then cooled to 35 C with stirring and the fragrance is added. The batch is allowed to cool to room temperature with slow agitation.

Finally, the gel is inserted into the pouch and an inert gas blanket is positioned around the gel in order to create an inert atmosphere around the gel in the pouch. The inert gas blanket around the gel maintains the gel at a homogeneous consistency and prevents the gel from foaming before it comes into contact with a heated object, such as human skin. Pouches may be purged with a typical inert gas, such as nitrogen, argon, carbon dioxide, nitrous oxide, but the most preferable inert gas is nitrogen. Nitrogen is a preferred gas for the inert gas blanket in that nitrogen does not negatively interfere with the function or safety of the shave gel product. Nitrogen is lighter than air while argon is 50% heavier than air. Nitrogen is a colorless, tasteless and odorless gas. It is non-flammable and does not support combustion. Nitrogen provides an inert (non-oxidizing) atmosphere and enhances the stability of the gel at elevated temperatures. Pouches have approximately 5 ml of head space which is replaced by a 5 ml of nitrogen layer. The nitrogen level may vary from about 5 ml to about 10 ml. Preferably, about 3–10 grams of shave gel are placed within each pouch. Most preferably, about 5 grams of shave gel are placed within each pouch. Following the creation of the inert gas blanket the pouch is sealed and ready for shipment to the consumer. Once filled, the pouch of shave gel will remain in a usable form until the pouch is opened and the contents come into contact with a heated object such as skin. To use the gel, the consumer will tear open the pouch and squeeze the shave gel onto his or her hands. The consumer should then rub the hands together and this action, along with the accompanying body heat, will cause the isopentane in the gel to boil and thereby produce a foam.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

We claim:

1. A method for producing a pouch containing a shave gel, comprising the steps of a) providing an empty pouch;

b) creating a shave gel mixture by mixing a shave gel material with an isocarbon;

c) placing the shave gel mixture in a container;

d) spraying the shave gel mixture with nitrogen;

e) sealing the container;

f) swirling the container to cause the shave gel mixture to form a non-aerated gel;

g) placing the non-aerated gel in the pouch;

h) placing an inert atmosphere around the non-aerated gel; and

I) sealing the pouch.

2. A method according to claim 1, including the step of creating the inert atmosphere around the non-aerated gel via placing nitrogen around the non-aerated gel.

3. A method according to claim 2, further comprising the step of printing graphics on the pouch.

* * * * *